US005259543A

United States Patent [19]

Downing

[11] Patent Number: 5,259,543

[45] Date of Patent: Nov. 9, 1993

[54] PARTING TOOL FOR TRACTOR FEED PAPER

[75] Inventor: Oren M. Downing, Oracle, Ariz.

[73] Assignee: Optimum Corporation, Oracle, Ariz.

[21] Appl. No.: 879,174

[22] Filed: May 5, 1992

Related U.S. Application Data

[63] Continuation-in-part of Ser. No. 743,735, Aug. 12, 1991, abandoned.

[51] Int. Cl.[5] ..... B26F 3/02; B41J 11/68

[52] U.S. Cl. ..... 225/99; 225/106; 400/621.1

[58] Field of Search ..... 83/423, 425, 425.2, 83/564; 225/1, 2, 93, 101, 106, 3, 99, 100; 400/621.1

[56] References Cited

U.S. PATENT DOCUMENTS

| | | | |
|---|---|---|---|
| 2,399,154 | 4/1946 | Antrim et al. | 83/423 |
| 2,477,128 | 7/1949 | Hope, Jr. | 83/423 |
| 4,423,975 | 1/1984 | Krenz | 400/616 |
| 4,940,347 | 7/1990 | Lund | 400/621.1 |
| 5,036,739 | 8/1991 | Clar | 83/422 |

FOREIGN PATENT DOCUMENTS

| | | | |
|---|---|---|---|
| 2601291 | 1/1988 | France | 400/621.1 |
| 0297163 | 12/1986 | Japan | 400/621.1 |

*Primary Examiner*—Eugenia Jones
*Attorney, Agent, or Firm*—Cahill, Sutton & Thomas

[57] ABSTRACT

A parting tool is attached to a tractor feed mechanism for separating the guide strip from the tractor feed paper as the paper passes through the mechanism. The parting tool includes a blade intersecting the plane of the paper for shearing the paper along the perforations connecting the guide strip to the sheets of paper.

9 Claims, 2 Drawing Sheets

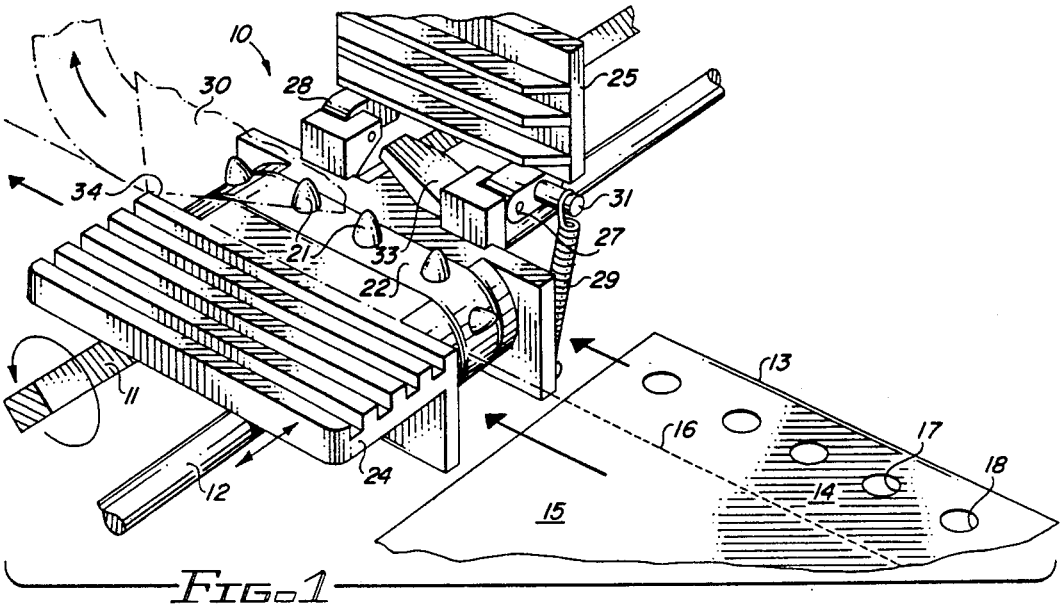
FIG. 1
FIG. 2
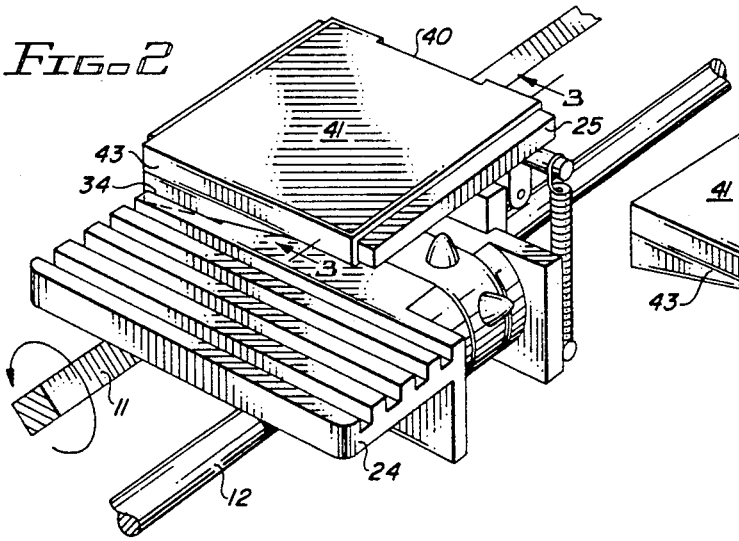
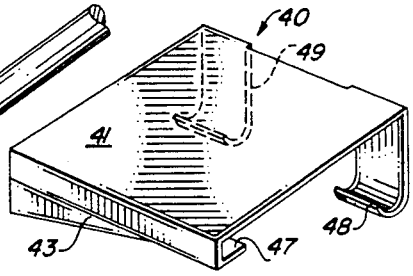
FIG. 4
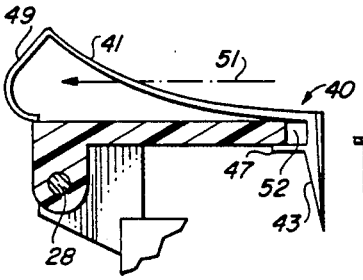
FIG. 5
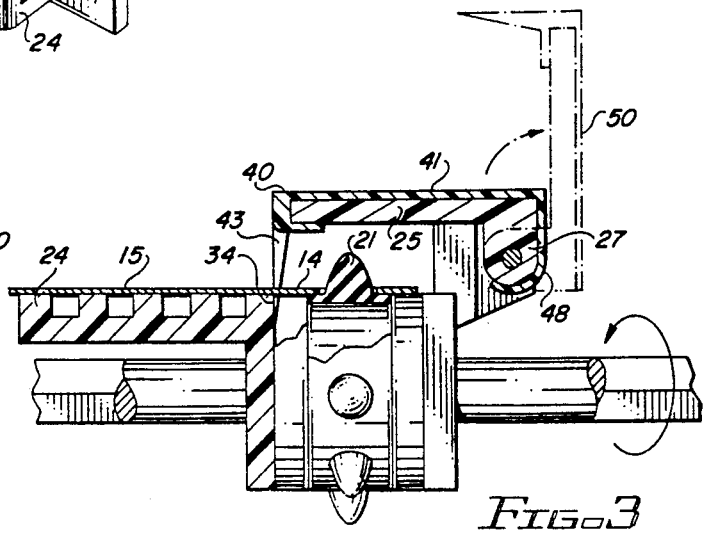
FIG. 3

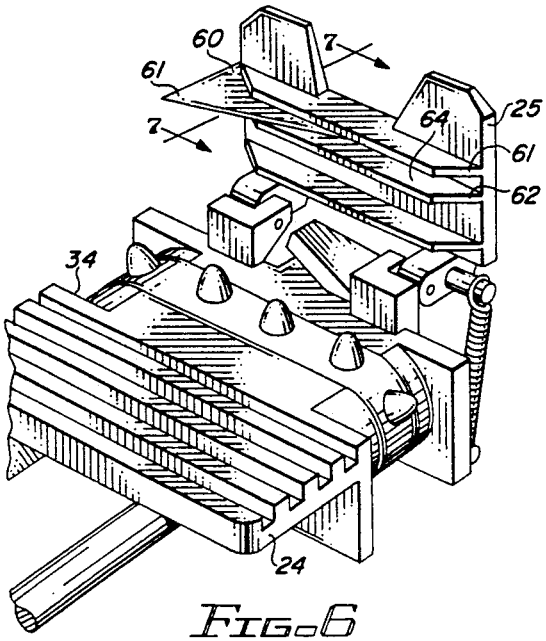
FIG. 6
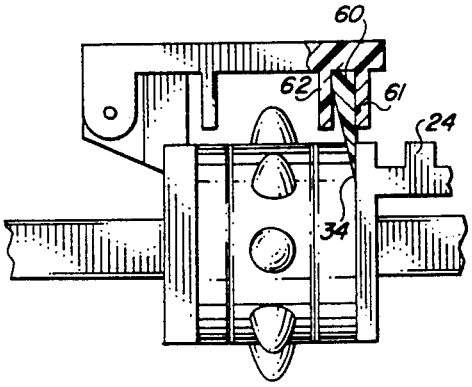
FIG. 7
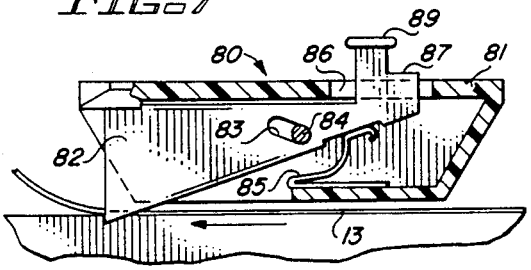
FIG. 10
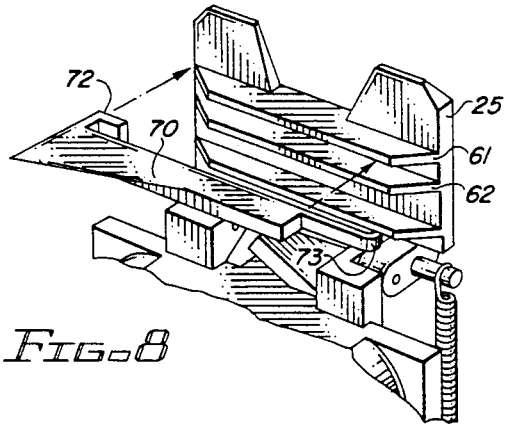
FIG. 8
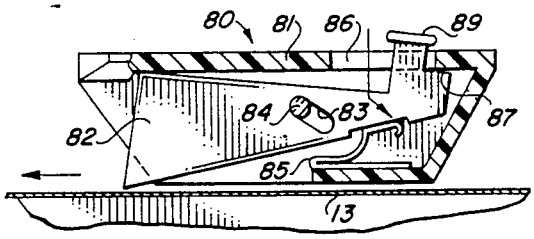
FIG. 11
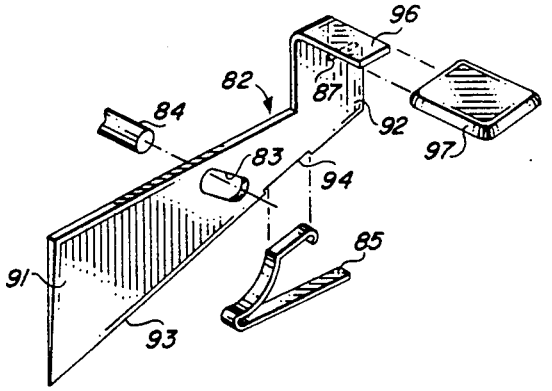
FIG. 12
FIG. 9
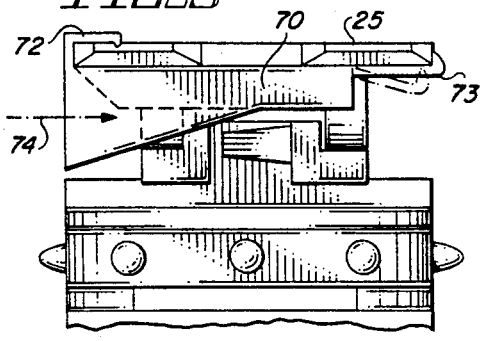

PARTING TOOL FOR TRACTOR FEED PAPER

CROSS-REFERENCE TO RELATED APPLICATION

This application is a continuation-in-part of Ser. No. 07/743,735, filed Aug. 12, 1991, and abandoned May 5, 1992.

BACKGROUND OF THE INVENTION

This invention relates to tractor feed printers and, in particular, to a parting tool for separating the guide strips on the sides of fan-fold paper from the main body of the paper.

The hard copy or printout from a computer can be produced by several different kinds of printers, e.g. laser or xerographic, dot matrix, or daisy wheel. A laser printer uses a stack of separate sheets of paper in a tray and has a complex paper handling mechanism to feed the sheets one at a time to the printing mechanism. The other kinds of printers use either a friction feed mechanism or a tractor feed mechanism for moving the paper past a print mechanism.

A friction feed mechanism pinches the paper between two rollers, one of which is driven by a small electric motor. The paper for a friction feed printer is either in single sheets or is continuous. By continuous is meant a roll of paper with rows of perforations across the width of the roll. The spacing of the rows determines the length of a page. The paper is folded along the perforations alternately in opposite directions, resembling a fan or accordion. A problem with friction fed, continuous paper is that the paper drifts out of alignment when more than a few pages are printed.

A tractor feed mechanism overcomes the problem of drift by using sprockets to engage holes in the paper. The paper for tractor feed printers is continuous, as described above, with a narrow guide strip on each side along the length of the paper. The guide strip has a plurality of regularly spaced holes for engaging the sprockets in the tractor feed mechanism to advance the paper. Each guide strip is typically one half inch wide and is separated from the sheet by a tear line or perforations.

Although the pages of a printout are often left joined end to end, the guide strips on the sides are usually removed. For example, storing a printout in a folder can be a problem because the paper is not a standard width with the guide strips. The paper cannot be punched for storage in a three ring binder because of the guide strips. Removing the guide strips page by page is a time consuming chore. Simultaneously removing the guide strips from one side of all of the pages often tears a page of the printout or tears the guide strips, leaving small segments that must be removed individually. Re-printing torn pages is a time consuming and unproductive activity.

Although the problem of removing the guide strips has been addressed in the prior art, the solutions proposed involve tearing the guide strips simultaneously from one side of a printout. For example, U.S. Pat. No. 4,529,113 discloses a clamp for holding the guide strips while they are torn from one side of the printout. U.S. Pat. No. 4,657,163 discloses a clamp having a wedge pressed against the printout at the perforations to promote tearing. U.S. Pat. No. 4,782,986 discloses a clamp with a pivoting upper jaw to facilitate separating the guide strips from the sheets. U.S. Pat. No. 4,886,198 discloses a blade and a recess on opposite sides of the perforations to facilitate tearing the guide strip from one side of the printout.

In view of the foregoing, it is therefore an object of the invention to provide a parting tool for shearing both guide strips simultaneously from tractor feed paper.

Another object of the invention is to provide a tool for continuously removing the guide strips from each sheet of paper as it comes from a tractor feed printer.

A further object of the invention is to provide a parting tool which can be attached to or be an integral part of the tractor feed mechanism of a printer.

Another object of the invention is to provide a parting tool which can be selectively disabled without being removed from a tractor feed mechanism.

SUMMARY OF THE INVENTION

The foregoing objects are achieved by a parting tool having a blade positioned adjacent an edge of the sprocket drive on each side of the paper. The edge underlies the perforations along the sides of the paper and a portion of the blade extends through the plane of the paper at the perforations. As the paper is advanced, the blade is forced between the guide strip and the sheet portion of the paper, separating them. The separation continues as the paper is fed through the printer. In one embodiment of the invention, the blade is integral with the sprocket drive. In another embodiment of the invention, the blade includes a clip for attachment to the sprocket drive. In accordance with another aspect of the invention, a blade pivots in a holder between two positions, the parting tool being enabled in one position and disabled in the other position.

BRIEF DESCRIPTION OF THE DRAWINGS

A more complete understanding of the invention can be obtained by considering the following detailed description in conjunction with the accompanying drawings, in which:

FIG. 1 illustrates the location of the blade portion of a parting tool relative to the paper and the sprocket drive.

FIG. 2 illustrates a clip-on parting tool constructed in accordance with one embodiment of the invention.

FIG. 3 is a cross-section along line 3—3 in FIG. 2.

FIG. 4 is a perspective view of the parting tool shown in FIGS. 2 and 3.

FIG. 5 illustrates attaching the parting tool to the cover of a sprocket drive.

FIG. 6 illustrates a parting tool constructed in accordance with an alternative embodiment of the invention.

FIG. 7 is a cross section of the parting tool shown in FIG. 6.

FIG. 8 is an exploded view of a sprocket drive having a parting tool attached to the underside of an open cover.

FIG. 9 is a top view of the sprocket drive of FIG. 8, showing the parting tool attached to the open cover.

FIG. 10 illustrates a parting tool constructed in accordance with an alternative embodiment of the invention in which the blade is in a cutting position.

FIG. 11 shows the parting tool of FIG. 10 with the blade in a non cutting position.

FIG. 12 is an exploded view of the blade structure from the parting tool of FIGS. 10 and 11.

DETAILED DESCRIPTION OF THE INVENTION

FIG. 1 illustrates sprocket drive 10 mounted on drive bar 11 and idler bar 12. FIG. 1 illustrates the right hand sprocket drive for moving paper 13 through a printer (not shown). A second sprocket drive (not shown), constructed in mirror image to sprocket drive 10, guides the left hand side of paper 13 through the printer. Paper 13 includes guide strip 14 connected to sheet 15 by perforations 16. Guide strip 14 includes a plurality of holes spaced at regular intervals, such as holes 17 and 18. The holes engage a plurality of regularly spaced sprockets, such as sprockets 21 on belt 22. Belt 22 is turned by suitable means (not shown) engaging drive bar 11 within the body of sprocket drive 10.

Sprocket drive 10 includes platform 24 and cover 25. Cover 25 is connected to the body of sprocket drive 10 by hinges 27 and 28. Spring 29 is connected to post 31 on hinge 27 to hold cover 25 in either an open or a closed position. Lever 33 actuates a cam-type mechanism (not shown) for securing sprocket drive 10 to idler bar 12, preventing side to side motion of sprocket drive 10.

As described thus far, the construction and operation of sprocket drive 10 is known in the art. In accordance with the invention, blade 30 is positioned relative to edge 34 of platform 24 to engage perforations 16 and separate guide strip 14 from sheet 15. There are several mechanisms by which blade 30 can be held in this spatial relationship.

FIG. 2 illustrates a parting tool constructed in accordance with a preferred embodiment of the present invention in which the parting tool clips onto cover 25. Parting tool 40 includes a first, generally planer member 41 from which blade 43 depends. The length of blade 43 extends along one side of member 41 and the width of blade 43 is in an approximately vertical direction when the blade is in the cutting position. Blade 43 is preferably positioned adjacent edge 34 to engage perforations 16 as paper 13 is fed through the printer.

The width of blade 43 is tapered. The proximal end of blade 43, i.e. the end first encountered by the paper, is above the plane of the paper and above the plane of the upper surface of platform 24. Because of the gradually increasing width of blade 43, the distal end of blade 43 is below the plane of the paper and below the plane of the upper surface of platform 24. Thus, as the paper is fed through the sprocket drive, blade 43 forces guide strip 14 downward, out of the plane of sheet 15, shearing or tearing the two along perforations 16 and separating the guide strip from the sheet of paper.

FIG. 3 illustrates parting tool 40, in partial cross-section, attached to cover 25 and FIG. 4 shows the parting tool itself. Parting tool 40 includes member 47 forming a pocket which surrounds the edge of cover 25 adjacent blade 43. Hooks 48 and 49 attach parting tool 40 to the opposite side of cover 25. The shape and proportion of the parting tool depend upon the particular sprocket drive to which the parting tool is attached. The tool is configured to hold blade 43 in a position to engage perforations 16 and separate the guide strip from the sheet.

In the position shown in FIG. 3 by solid lines, parting tool 40 separates guide strip 14 from sheet 15 by a shearing action as the paper is fed through the sprocket drive. If cover 25 is moved to an open position, indicated by reference numeral 50, blade 43 no longer engages the paper and the paper can be fed without separating guide strip 14 from sheet 15. Thus, parting tool 40 can be installed and left in place, yet can be enabled or disabled at the discretion of the user.

The downward pressure on the guide strip separates the guide strip from the sheet. The lower edge of blade 43 can be beveled from either side, like a wood chisel, or from both sides, like a cold chisel, or not beveled at all and left square, like a ski or a runner on a sled, so long as a portion of the lower edge is above the plane of the paper and a portion of the lower edge is below the plane of the paper.

As shown in FIG. 5, parting tool 40 is attached to cover 25 by flexing member 41 and moving parting tool 40 in the direction of arrow 51 to insert the edge of cover 25 into pocket 52. Hook 49 then slips over hinge 28 to hold parting tool 40 in place. Member 41 is not deformed in this process and returns to its former planar shape.

Parting tool 40 can be made of metal but is preferably made from plastic. For either material, the parting tool is somewhat flexible, enabling the tool to be easily installed or removed. Blade 43 need not have any particular hardness since the paper is perforated and the guide strip is readily separated from the sheet. Wear on blade 43 is minimal, even with extensive use, because the blade is not cutting the guide strip but is pushing the guide strip downward.

FIG. 6 illustrates a parting tool constructed in accordance with an alternative embodiment of the present invention in which blade 60 is permanently attached to cover 25. Ribs 61 and 62 are part of cover 25 and serve to hold the paper in place as it passes through the sprocket drive. Blade 60 fits between ribs 61 and 62 and is attached to the ribs by any suitable means, e.g. a pin through ribs 61 and 62 and blade 60, or adhesive. The width of blade 60 is tapered, decreasing from distal end 61 to proximal end 64.

FIG. 6 illustrates blade 60 in the open or disabled position. FIG. 7 illustrates blade 60 in the closed or enabled position. Distal end 61 of blade 60 is below the plane of the paper and below the upper surface of platform 24. Blade 60 is adjacent edge 34 and engages the perforations separating guide strip 14 from sheet 15. As it passes through the tractor feed mechanism, the paper (not shown in FIG. 7) encounters the slanted edge of blade 60. Although the blade does not move, the paper does move and it is sheared between blade 60 and edge 34 as it moves.

FIG. 8 illustrates an alternative embodiment of the invention in which blade 70 is attached to cover 25 and located between ribs 61 and 62. Blade 70 has a thickness equal to the spacing between ribs 61 and 62 and a tapered width. The distal end of blade 70 includes hook 72 and the proximal end of the blade includes hook 73.

As shown in FIG. 9, blade 70 is installed by inserting it between ribs 61 and 62 and connecting clip 75 to one edge of cover 25. Blade 70 is moved in direction 74 and clip 73 snaps into place around the opposite edge of cover 25, holding blade 70 between ribs 61 and 62.

The parting tool illustrated in FIGS. 8 and 9 operates in the same manner as the other embodiments. The blade engages the paper when cover 25 is in a closed position and does not engage the paper when cover 25 is in an open position. Although this provides a convenient way to operate the parting tool without having to remove it from the sprocket drive, operating with the cover open runs the risk of having the guide strips disengage from the sprocket drive. Thus, it is preferable to keep cover 25 closed to assure that the guide strip engages the sprocket drive at all times.

FIGS. 10–12 illustrate an alternative embodiment of the invention wherein the parting tool can be permanently attached to the sprocket drive and yet be selectively enabled or disabled. In FIG. 10, parting tool 80 is an integral part of the cover and includes housing 81 containing blade 82 in either an enabled or a disabled position. Blade 82 has a tapered width as described above and includes slot 83 for engaging pin 84 attached to housing 81. Pin 84 passes through slot 83, enabling blade 82 to pivot and to move longitudinally within housing 81.

Compressed spring 85 between the lower edge of blade 82 and housing 81 holds blade 82 in a first position in which the upper edge of blade 82 rests against the inside of housing 81 and the distal end of blade 82 is below the plane of paper 13. Pin 84 is at the right hand end of slot 83 and the upper edge of blade 82 acts as a shoulder for locating the blade in a first position.

Housing 81 includes slot 86 through which a portion of blade 82 extends. The proximal end of blade 82 includes shoulder 87 and tab 89. Pushing downwardly on tab 89 moves blade 82 into the position illustrated in FIG. 11. Specifically, blade 82 pivots slightly about pin 84, rotating the proximal end downwardly and the distal end upwardly. In addition, shoulder 87 engages the underside of the proximal end of slot 86 as blade 82 moves slightly to the right. Spring 85 is further compressed, holding shoulder 87 against housing 81. Pin 84 is at the left hand end of slot 83. Since the distal end of blade 82 has been raised, it no longer penetrates the plane of paper 13 and the paper passes through the sprocket drive with the guide strip intact.

FIG. 12 is a detailed illustration of blade 82, showing pin 84 removed from slot 83. Distal end 91 of blade 82 is wider than proximal end 92, forming a taper so that edge 93 passes through the plane of the paper. Notch 94 in edge 93 is located above the intersection of edge 93 with the paper and provides a hold for spring 85. Spring 85 can be made from either metal or plastic. Proximal end 92 includes shoulder 87, as described above, and tab 96. Tab 96 preferably includes a plastic cover such as cover 97 to provide a large, perhaps brightly colored, handle for the user to press down or to lift up for disabling or enabling the parting tool.

A parting tool constructed in accordance with the present invention thus provides a simple mechanism for shearing both guide strips simultaneously from a tractor feed printer as the paper is fed through the tractor feed mechanism. The parting tool can be an integral part of the tractor feed mechanism or a separate element, easily attached to the sprocket drive on each side of the paper. In addition, the parting tool can be selectively disabled without being removed from the tractor feed mechanism or without moving the cover of a tractor feed mechanism.

Having thus described several embodiments of the invention, it will be apparent to those of skill in the art that various modifications can be made within the scope of the invention. For example, although illustrated in conjunction with a particular sprocket drive, it is understood that a variety of sprocket drives are on the market and the parting tool can be readily adapted to the different configurations. For example, some sprocket drives use a wheel with sprockets rather than a belt. This has no effect on the operation of the parting tool. As previously described, the taper of the width of the blade separates the guide strip from the sheet. A rectangular, or any other shaped, blade held at an angle accomplishes the same result if the lower edge of the blade extends through the plane of the paper. The blade can even be a wheel turning on a center above the plane of the paper and having a portion of its periphery below the plane of the paper. Any resilient means can be used as a spring, e.g. a foam pad.

I claim:

1. A parting tool for separating a guide strip from paper used in printers having a tractor feed mechanism for moving said paper, said tractor feed mechanism including a cover for holding said paper in a plane as said paper is moved through said tractor feed mechanism, the parting tool comprising:

an elongated blade, extending in a direction approximately parallel to the direction said paper is moved, for pushing said guide strip out of said plane to tear said guide strip from said paper; and at least two hooks attached to said blade for removably connecting said blade to said cover.

2. The parting tool as set forth in claim 1 wherein said blade extends through the plane of said paper.

3. The parting tool as set forth in claim 2 wherein said blade has a tapered width.

4. The parting tool as set forth in claim 1 wherein one of said hooks is located at one end of said blade and the other of said hooks is located at the other end of said blade.

5. The parting tool as set forth in claim 1 and further comprising a member having said blade attached to one side thereof and said hooks attached to said member on a side opposite said blade for engaging said cover and holding said blade in place.

6. A tractor feed mechanism for moving paper past a printing mechanism, said paper having a guide strip on each side along the length thereof, said tractor feed mechanism including a drive bar and first and second guides attached to said bar at separate locations along said drive bar, wherein each of said guides includes:

a sprocket drive for engaging a guide strip to move said paper through the guide in a predetermined direction, wherein said sprocket drive holds said paper in a plane;

a blade for tearing a guide strip from said paper by pushing said guide strip out of said plane as said paper moves through said guide, wherein said blade (i) is elongated in a direction approximately parallel to the direction said paper is moved;

(ii) includes a slot and said guide includes a pin through said slot for pivotally attaching said blade to said guide; and (iii) can pivot and move between (a) a first position for removing said guide strip, wherein a portion of said blade extends through said plane, and (b) a second position for not removing said guide strip wherein said portion does not extend through said plane.

7. The tractor feed mechanism as set forth in claim 6 wherein each guide includes a housing and further comprising a spring in each guide between each blade and each housing.

8. The tractor feed mechanism as set forth in claim 7 wherein each blade includes a shoulder for holding said blade in said second position.

9. The tractor feed mechanism as set forth in claim 7 wherein each housing includes a slot and the shoulder of the blade extends through said slot in said housing when said blade is in said first position and said shoulder engages said housing when said blade is in said second position.

* * * * *